US006309501B1

(12) United States Patent
Kelley

(10) Patent No.: US 6,309,501 B1
(45) Date of Patent: Oct. 30, 2001

(54) METHOD FOR MAKING A BEVELED LAMINATE CORNER ON A LAMINATE COUNTERTOP EDGE PIECE

(76) Inventor: Basil T. Kelley, 13565 SW. Tualatin Sherwood Rd., Sherwood, OR (US) 97140

( * ) Notice: Subject to any disclaimer, the term of this patent is extended or adjusted under 35 U.S.C. 154(b) by 0 days.

(21) Appl. No.: 09/444,245

(22) Filed: Nov. 19, 1999

(51) Int. Cl.[7] ..... B32B 31/00

(52) U.S. Cl. ..... 156/257; 156/258; 156/268; 156/182; 156/293; 144/344; 144/345; 144/346; 144/348; 144/352; 144/355; 52/796.11; 52/782.2

(58) Field of Search ..... 156/257, 258, 156/268, 182, 293; 144/344, 345, 346, 348, 352, 355; 52/796.11, 782.2

(56) References Cited

U.S. PATENT DOCUMENTS 2,717,187 * 9/1955 Morgan et al. ..... 52/782.2
4,008,551 * 2/1977 MacDonald et al. ..... 52/316
5,085,027 * 2/1992 McClung et al. ..... 52/796.1

* cited by examiner

*Primary Examiner*—Linda Gray
(74) *Attorney, Agent, or Firm*—Chernoff, Vilhauer, McClung & Stenzel

(57) ABSTRACT

A method for making a beveled laminate corner on an edge piece for laminate countertop includes making a first cut into a laminate-covered edge piece at the angle of the bevel at the front edge of the edge piece. The first cut terminates below the laminate at the top of the edge piece. A second cut is made through the laminate and into the edge piece at an angle that is normal to the first cut. The second cut intersects the first cut at its upper extremity and has a predetermined depth. A rectangularly cross-sectioned laminate-covered bevel piece, having a thickness equal to said predetermined depth, is then adhesively attached to the edge piece abutting the surfaces formed by the first and second cuts.

6 Claims, 1 Drawing Sheet

METHOD FOR MAKING A BEVELED LAMINATE CORNER ON A LAMINATE COUNTERTOP EDGE PIECE

BACKGROUND AND SUMMARY OF THE INVENTION

It often is desirable to place a bevel on the upper corner of an edge piece which is attached to the front edge of a laminate covered countertop. If the top and edge of the edge piece are both covered with laminate it is difficult to do this and still get a sharp, straight edge between the laminate on the top of the edge piece and the laminate on the bevel. Laminate varies too much in thickness to simply glue a strip of laminate on a beveled cut in an edge piece having laminate attached to its top surface.

One way this has been accomplished in the past is to use a single sheet of laminate to cover both the top of the edge piece and the beveled corner. A notch is cut in the underside of the laminate sheet along a line that will overlie the intersection of the top surface and the bevel. The sheet is then bent at the notch and adhesively attached to the edge piece substrate. An edge piece made using this cut and fold technique is shown in FIG. 2 of the drawings. The preferred way to attach laminate to a substrate is with a rigid set adhesive, which requires the laminate to be accurately placed on the substrate and held in place while the adhesive cures. This is extremely difficult to do with a cut and fold sheet of laminate, so contact cement is used as the adhesive with this method. Laminate attached with contact cement is not as permanent as laminate attached with a rigid set adhesive. In addition, this method does not allow the laminate on the bevel to be of a different color than the laminate on the top surface.

Another way that laminate has been attached to a beveled corner in the past is shown in FIG. 3. A sheet of laminate is attached to the top surface of the edge piece substrate and a bevel is cut at the leading edge of the substrate at an angle which is normal to the desired bevel angle. An elongate block of material having a strip of laminate attached to one side is then glued onto the bevel cut. Since the laminate is attached to the block before the block is attached to the substrate, it can be attached with rigid set adhesive. However, in order to create a sharp intersection between the laminate on the substrate and the laminate on the block, the block has to be precisely aligned on the substrate and held in this alignment while the adhesive cures. When edge pieces are mass produced, this requires an elaborate clamping jig, which adds to the cost of producing the edge pieces.

The subject invention overcomes the shortcomings and limitation of the prior art methods for making a beveled laminate corner on a laminate covered countertop edge piece or other countertop element by making a first cut proximate the vertical edge of the edge piece substrate. The first cut has an upper extremity which is below the laminate and it creates a first edge surface which is angled with respect to the top surface. A second cut is made through the laminate and into the substrate which intersects the first cut at its upper extremity to create a second edge surface which is perpendicular to the first edge surface. The second cut has a predetermined depth. A rectangular cross-sectioned laminate-covered bevel piece having a thickness equal to the predetermined distance is then adhesively attached to the first and second edge surfaces.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
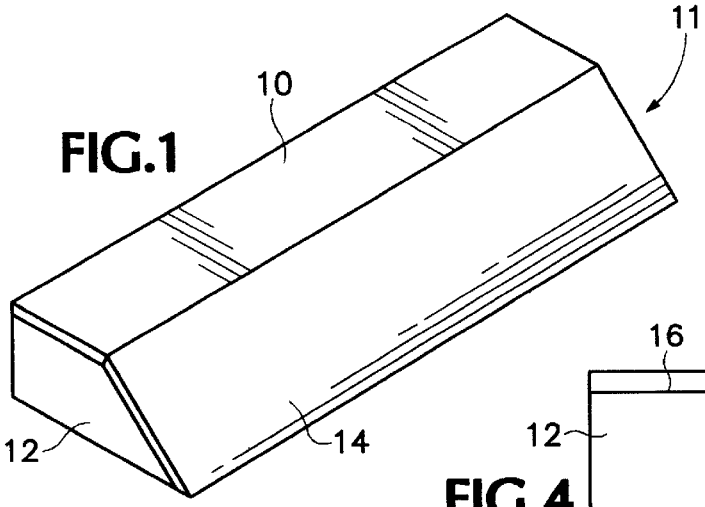
FIG. 1 is a fore-shortened perspective view of a countertop edge piece made according to the subject invention.
Figure 2:
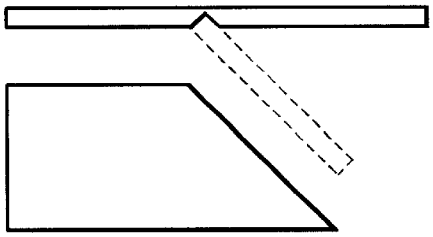
FIG.2 (PRIOR ART)
FIG. 2 is a cross-sectional view showing a prior art method of making a countertop edge piece.
Figure 3:
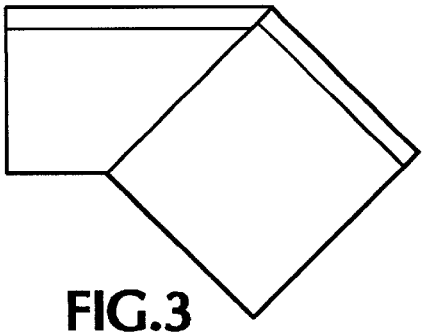
FIG.3 (PRIOR ART)
FIG. 3 is a cross-sectional view of another prior art method of making a countertop edge piece.

Referring to FIG. 1, it is common to finish the edge of a countertop by adhesively attaching an edge piece 11 to the unfinished edge of the countertop. If the countertop is laminate covered, the edge piece also will have a laminate 10 or veneer surface which is adhesively attached to a wood or a manufactured wood product substrate 12. By a laminate I mean any veneer product, typically available in sheet form, meant to be used as a decorative or protective surface when adhered to a substrate. Rather than having the laminate 14 that covers the front edge of the edgepiece be on the vertical edge of the substrate, it often is desirable for the edge piece to have an angled or beveled corner. The subject invention provides a method for constructing an edgepiece for a laminate countertop with such a beveled corner.

Figure 4:
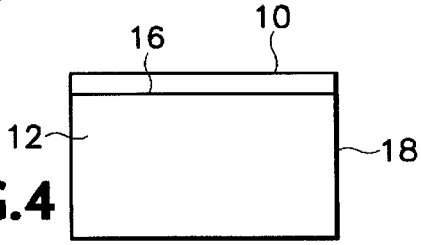
FIG. 4 is a cross-sectional view of an edge piece substrate.

Referring now to FIG. 4, a preferred embodiment of the subject invention provides a planar substrate 12 having a length equal to the width of the countertop to which it will be attached. A strip of laminate 10 or veneer is attached to the top of the substrate, preferably with a rigid set adhesive. Alternatively, the substrate and laminate can be obtained as an integral unit. The laminate is co-extensive with the top surface 16 of the substrate and the front edge surface 18 of the substrate is normal to the top surface 16. The substrate can be cut to its desired width and length either before or after the laminate is installed.

Figure 5:
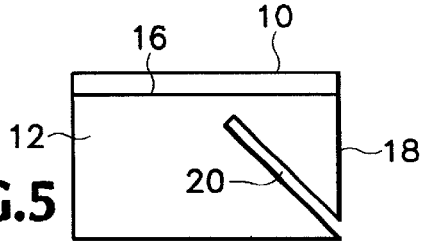
FIG. 5 is a cross-sectional view of the edge piece substrate of FIG. 4 with a first cut in it.

Referring now to FIG. 5, a first cut 20 is made into the substrate. The first cut starts at the bottom of the substrate next to the front edge surface 18 and angles upwardly and inwardly. It extends along the entire length of the edge piece. The first cut is made at the angle that is desired for the beveled corner. The first cut does not go completely through the substrate, but stops below the top surface 16. The first cut 20 creates a first edge surface 22 in the substrate. The cut has a predetermined depth sufficient for the bevel piece to be self-supporting without bending. The depth is between 0.050 and 0.20 inches, especially approximately 0.10 inches.

Figure 6:
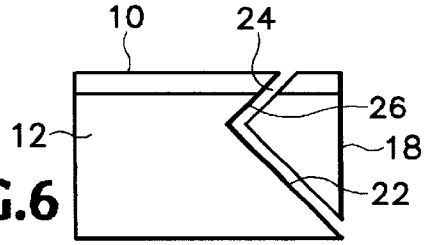
FIG. 6 is a cross-sectional view of the edge piece substrate of FIG. 4 with a first and second cut in it.

Referring now to FIG. 6, a second cut 24 is made from the top of the edge piece through the laminate 10 and into the substrate 12. The second cut is normal to the first cut and intersects the first cut at its upper extremity. The second cut also extends along the entire length of the edge piece and it has a predetermined depth. The second cut creates a second edge surface 26 in the edge piece. Once the second cut is made, the first and second edge surfaces 22 and 24 are exposed and form the edge of the edge piece.

Figure 7:
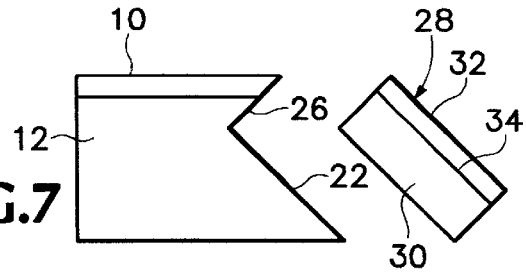
FIG. 7 is a cross-sectional view of the edge piece substrate of FIG. 6 with a bevel piece ready to be attached.
Figure 8:
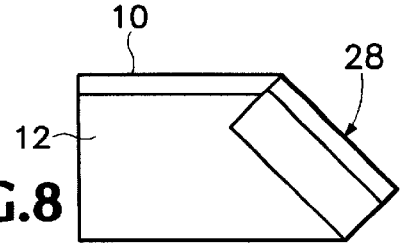
FIG. 8 is a cross-sectional view of an edge piece substrate with the bevel piece attached.

A rectangularly cross-sectioned bevel piece 28, FIG. 7, has a wood or manufactured wood product base 30 and a laminate strip 32 adhesively attached to one of its outer faces 34. The length of the bevel piece is equal to the length of the edge piece, its width is equal to the width of the first edge surface 22 and its thickness is equal to the width of the second edge surface 26. This predetermined thickness is sufficient to provide enough wood to make the bevel piece self-supporting. The thickness of the bevel piece is established by removing wood from the base 30 after the laminate sheet 32 has been attached. Thus, the thickness of the bevel piece can be made uniform along its entire length and equal to the width of the second edge surface 26. The bevel piece is then adhesively attached to the first and second edge surfaces 22, 26, preferably with a rigid set adhesive.

Because the thickness of the bevel piece is uniform and equal to the width of the second edge surface, and because the bevel piece abuts both the first and second edge surfaces, the bevel piece is easily indexed at the proper location on the substrate 12, and the laminate strip 32 on the bevel piece forms a sharp corner with the laminate sheet 10. Moreover, because of the rigidity of the bevel piece it is easily held in place while the adhesive cures.

In addition to the ability to form sharp corners without the necessity of substantial clamping jigs, the subject invention also allows making beveled corners on laminate countertops where the laminate on the corner is a different color than the laminate on the top.

While the foregoing description relates to an edge piece for a countertop, the method of the subject invention can be used to place a beveled corner directly on any type of countertop element having an exposed edge including a unitary countertop.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for making a beveled laminate corner on a laminate covered countertop element comprising:

(a) providing a countertop element, including a substrate having a planer top surface and an edge surface which is normal to said top surface, said substrate having a predetermined length and width, and a sheet of laminate which is adhesively attached to said top surface;

(b) making a first cut into said substrate proximate said vertical edge, said first cut having an upper extremity which is below said top surface, said first cut creating a first edge surface which is angled with respect to said top surface;

(c) making a second cut through said sheet of laminate and into said substrate, said second cut intersecting said first cut at said upper extremity and being perpendicular to said first cut, said second cut having a predetermined depth, said second cut creating a second edge surface which is perpendicular to said first edge surface;

(d) providing a rectangularly cross-sectioned laminate-covered bevel piece having a thickness equal to said predetermined depth; and (e) adhesively adhering said bevel piece to said first and second edge surfaces such that an edge of the laminate covering on said bevel piece abuts an edge of the laminate sheet on said top surface, forming the beveled laminate corner.

2. The method of claim 1 wherein the laminate on said bevel piece is the same color as the laminate on said top surface.

3. The method of claim 1 wherein the laminate on said bevel piece is a different color than the laminate on said top surface.

4. The method of claim 1 wherein said predetermined depth is sufficient for said bevel piece to be self-supporting without bending.

5. The method of claim 4 wherein said predetermined depth is between 0.050 and 0.20 inches.

6. The method of claim 4 wherein said predetermined depth is approximately 0.10 inches.

* * * * *